US008720003B2

(12) United States Patent
Seo

(10) Patent No.: US 8,720,003 B2
(45) Date of Patent: May 13, 2014

(54) UPRIGHT TYPE VACUUM CLEANER

(75) Inventor: Jinwook Seo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 385 days.

(21) Appl. No.: 13/241,560

(22) Filed: Sep. 23, 2011

(65) Prior Publication Data

US 2012/0180257 A1 Jul. 19, 2012

(30) Foreign Application Priority Data

Jan. 18, 2011 (KR) ..... 10-2011-0004881

(51) Int. Cl.
*A47L 9/02* (2006.01)
*A47L 5/00* (2006.01)

(52) U.S. Cl.
USPC ..... 15/411; 15/351

(58) Field of Classification Search
USPC ..... 15/354, 411, 334, 336, 350, 351, 363, 15/338
IPC ..... A47L 9/02,5/00
See application file for complete search history.

(56) References Cited

U.S. PATENT DOCUMENTS

| | | | | | |
|---|---|---|---|---|---|
| 4,156,952 | A * | 6/1979 | Lynch, Jr. | ..... | 15/320 |
| 4,472,855 | A * | 9/1984 | Murphy et al. | ..... | 15/323 |
| 4,845,802 | A * | 7/1989 | Miller et al. | ..... | 15/321 |
| 7,823,251 | B2 * | 11/2010 | Dyson et al. | ..... | 15/336 |
| 8,522,396 | B2 * | 9/2013 | Worker et al. | ..... | 15/410 |
| 2003/0101536 | A1 * | 6/2003 | Hefter et al. | ..... | 15/339 |

FOREIGN PATENT DOCUMENTS

| | | | |
|---|---|---|---|
| JP | 11-178756 | A | 7/1997 |
| JP | 2000-116574 | A | 4/2000 |

* cited by examiner

*Primary Examiner* — Dung Van Nguyen
(74) *Attorney, Agent, or Firm* — Birch, Stewart, Kolasch & Birch, LLP

(57) ABSTRACT

An upright type vacuum cleaner is disclosed. And The upright type vacuum cleaner includes a main body comprising an arrangement angle that is changeable with respect to a surface to clean; a suction nozzle coupled to the main body, the suction nozzle movable along the surface to clean; a supporting unit provided in the main body to support the main body with respect to the main body; a connection member provided between the main body and the supporting unit, to rotatably connect the supporting unit with the main body; and a fixing member fixedly provided between the supporting unit and the connection member to limit the rotation of the supporting unit, to maintain the main body supporting of the supporting unit.

20 Claims, 7 Drawing Sheets

UPRIGHT TYPE VACUUM CLEANER

CROSS-REFERENCE TO RELATED APPLICATION

This application claims priority under 35 U.S.C. §119 from Korean Application No. 10-2011-0004881 filed Jan. 18, 2011, the subject matter of which is incorporated herein by reference.

BACKGROUND

1. Field

Embodiments may relate to an upright type vacuum cleaner, more particularly, to an upright type vacuum cleaner which is able to disperse load of a main body to enhance a steering ability of the main body.

2. Background

Generally, a vacuum cleaner is an electric appliance that filters dust, dirt and foreign matters scattered on a surface to clean together with air in a main body provided therein, after sucking them by using a suction motor mounted in the main body.

The vacuum cleaner may be classified into an upright type having a suction nozzle integrally formed with the main body as suction inlet and a canister type having a suction nozzle in communication with the main body via a connection pipe.

The upright type vacuum cleaner out of the two types of vacuum cleaners may include a vacuum cleaner main body, a suction nozzle and a handle. A suction motor that generates a suction force may be arranged in the main body. The suction nozzle may suck into the main body dust and foreign matters scattered on a surface which will be cleaned by using the suction force generated in the suction motor. The handle may be provided in an upper area of the vacuum cleaner main body to allow a user to grasp.

In other words, once an electric power is applied to the main body, the suction motor may be driven and the suction force may be generated. The suction force enables the suction nozzle to suck therein the dust and foreign matters scattered on the surface which will be cleaned.

The dust and foreign matters sucked into the suction nozzle may be drawn into the main body. The dust and foreign matters may be collected within a dust collection box provided in the main body by cyclone theory.

Also, the air sucked into the suction nozzle together with the dust and foreign matters may be exhausted outside the main body via an air outlet.

In the meanwhile, the upright type vacuum cleaner includes the main body in which the dust collection box for collecting dust and foreign matters therein and the suction nozzle for sucking dust and foreign matters scattered on the surface to clean.

When performing cleaning by using such the upright type vacuum cleaner, the user has to tilt the main body a predetermined angle with respect to the suction nozzle.

That is, the user grasps a handle provided on the main body and user supports the main body seated on the suction nozzle for the main body to maintain a rotated state toward the surface to clean, to perform the cleaning along the surface to clean.

However, when performing the cleaning of the surface by using such the upright type vacuum cleaner, the user has to support and move the main body rotated a predetermined angle simultaneously, with one hand. Such the conventional upright type vacuum cleaner might have a problem of the user's fatigue.

Because of that, the upright type vacuum cleaner provides the main body with a supporting unit for supporting the main body and load of the main body is dispersed, to allow the user not to feel fatigue easily even in performing cleaning for a relatively long time.

However, the vacuum cleaner is moving along the surface to clean during the cleaning, with the supporting unit supporting the main body. Because of that, the supporting unit might be separated from an original position supporting the main body by a frictional force generated between the surface to clean and the supporting unit.

SUMMARY

Accordingly, the embodiments may be directed to an upright type vacuum cleaner. To solve the problems, an object of the embodiments may be to provide an upright type vacuum cleaner which can prevent a supporting unit provided therein from separating from a position supporting a main body by providing with the supporting unit for supporting the main body with a fixing member, when a user performs cleaning.

To achieve these objects and other advantages and in accordance with the purpose of the embodiments, as embodied and broadly described herein, An upright type vacuum cleaner includes a main body comprising an arrangement angle that is changeable with respect to a surface to clean; a suction nozzle coupled to the main body, the suction nozzle movable along the surface to clean; a supporting unit provided in the main body to support the main body with respect to the main body; a connection member provided between the main body and the supporting unit, to rotatably connect the supporting unit with the main body; and a fixing member fixedly provided between the supporting unit and the connection member to limit the rotation of the supporting unit, to maintain the main body supporting of the supporting unit.

In another aspect, an upright type vacuum cleaner includes a main body comprising an arrangement angle that is changeable with respect to a surface to clean; a suction nozzle coupled to the main body, the suction nozzle moving along the surface to clean; a supporting unit provided in the main body to support the main body, when the main body is tilted with respect to the surface to clean; a connection member provided between the main body and the supporting unit to support the main body, to rotatably connect the supporting unit with the main body; and a fixing member fixedly provided between the supporting unit and the connection member, the fixing member configured to fix the supporting unit to the connection unit or to remove the fixing state based on a rotation direction of the supporting unit.

The embodiments have following advantageous effects. According to the embodiments, the load of the main body may not be concentrated on the handle but dispersed to the supporting unit and the handle, when the user performs cleaning, with tilting the main body in a state of grasping the handle. As a result, the user's physical fatigue may be reduced.

Furthermore, when user moving the upright type vacuum cleaner to perform cleaning, the user may move the main body, with the supporting unit supporting the main body being fixed to a position. As a result, moving convenience may be realized.

Especially, the position of the supporting unit may be elastically fixed by the elastic member, in the state of the main body being tilted. As a result, the supporting unit may be moved elastically and the characteristic of the fixed position may not be damaged, even when contacting with an outside object.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts.

Figure 1:
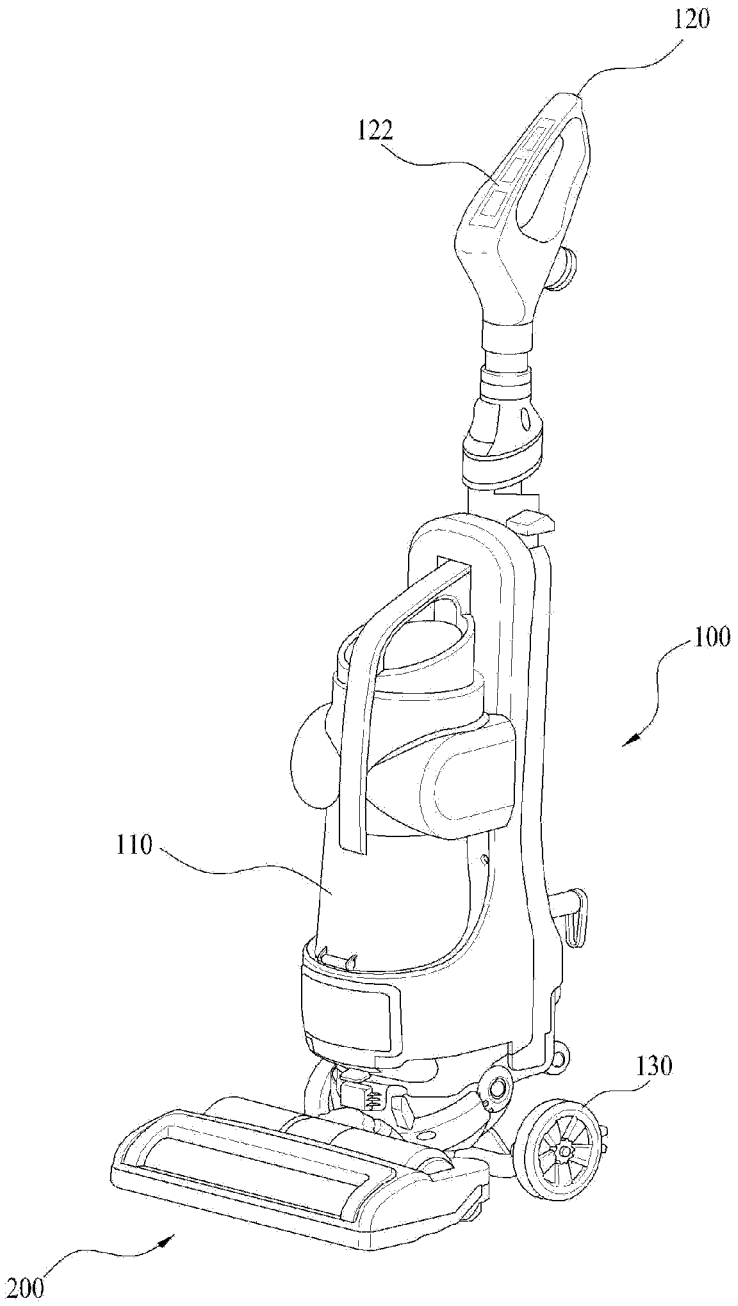
FIG. 1 is a perspective view illustrating a front surface of an upright type vacuum cleaner according to an embodiment.

FIG. 1 is a perspective view illustrating a front surface of an upright type vacuum cleaner according to an embodiment. The configuration and operation of the upright type vacuum cleaner may be described in detail in reference to FIG. 1.

The upright type vacuum cleaner shown in FIG. 1 may include a main body 100, a suction nozzle 200 and a handle 120. A dust collection box 110 may be arranged in the main body 100 and dust and foreign matters scattered on a surface to clean may be collected in the dust collection box 110. The suction nozzle 200 may be provided below the main body 100 to seat the main body 100 thereon and it may suck the dust and foreign matters scattered on the surface to clean air together with air. The handle 120 may be provided above the main body 100 to allow a user to grasp when user tries to perform cleaning.

The main body 100 may be rotatably coupled to the nozzle 200, with being seated on the suction nozzle 200. Because of that, the main body 100 may be provided with a variable arrangement angle with respect to the surface which is an object of the cleaning process. The user may grasp the handle 120 when performing the cleaning and user may support the main body 100 to allow the main body 100 to maintain a rotated state toward the surface to be cleaned.

The dust collection box 110 may be detachable coupled to a front surface of the main body 100 and it may include a dust separation member (not shown) that filters the dust and foreign matters contained in the air sucked into the main body 100 by cyclone theory.

In other words, the air sucked into the main body 100 via the suction nozzle 200 may be drawn into the dust collection box 110. The dust and foreign matters contained in the air drawn into the dust collection box 110 may be filtered by the dust separation member and the filtered dust and foreign matters may be collected in the dust collection box 110. After that, clean air having the dust and foreign matters separated there from may be exhausted outside the main body 100.

Also, the dust collection box 110 may be detachable coupled to the main body 100. When user desires to throw away the dust and foreign matters collected in the dust collection box 110, the user may separate the dust collection box 110 from the main body 100 easily.

In the meanwhile, the dust collection box 110 shown in FIG. 1 may be cylindrical shaped and it may be square-column-shaped or polygonal-column-shaped. The embodiment may not be limited to the shape of the dust collection box 110.

The suction nozzle 200 may be provided below the main body 100 and it may suck the dust and foreign matters scattered on the surface to clean, together with the air.

In other words, a inlet (not shown) having a slit shape cut-way along a longitudinal direction with respect to the suction nozzle 200 may be formed in a lower surface of the suction nozzle 200. A suction force generated by the suction motor (not shown) arranged in the main body 100 may be transferred to the inlet, to suck the dust and foreign matters scattered on the surface to clean into the main body 100.

In the meanwhile, a pair of wheels 130 may be rotatably provided in both sides of a lower end of the main body 100. When the user performs the cleaning, the suction nozzle 200 may be moving in forward/rearward and right/left directions with respect to the cleaned surface, to suck the dust and foreign matters located on the cleaned surface. The pair of the wheels 130 may be rotated to enable the suction nozzle 200 to move along the cleaning surface smoothly.

In the meanwhile, the handle 120 may be provided above the main body 100. Because of that, when performing the cleaning, the user may grasp the handle 120 and the main body 100 may be then supported to keep a predetermined angle rotated state.

An operation panel 122 may be provided on the handle 120. The user may push a button provided on the operation panel 122 to operate an operation condition of the upright type vacuum cleaner according to the embodiment.

For example, the user may control a suction level, a cleaning time of the suction nozzle 200 based on a state of the surface which will be cleaned, only to enhance user convenience.

Figure 2:
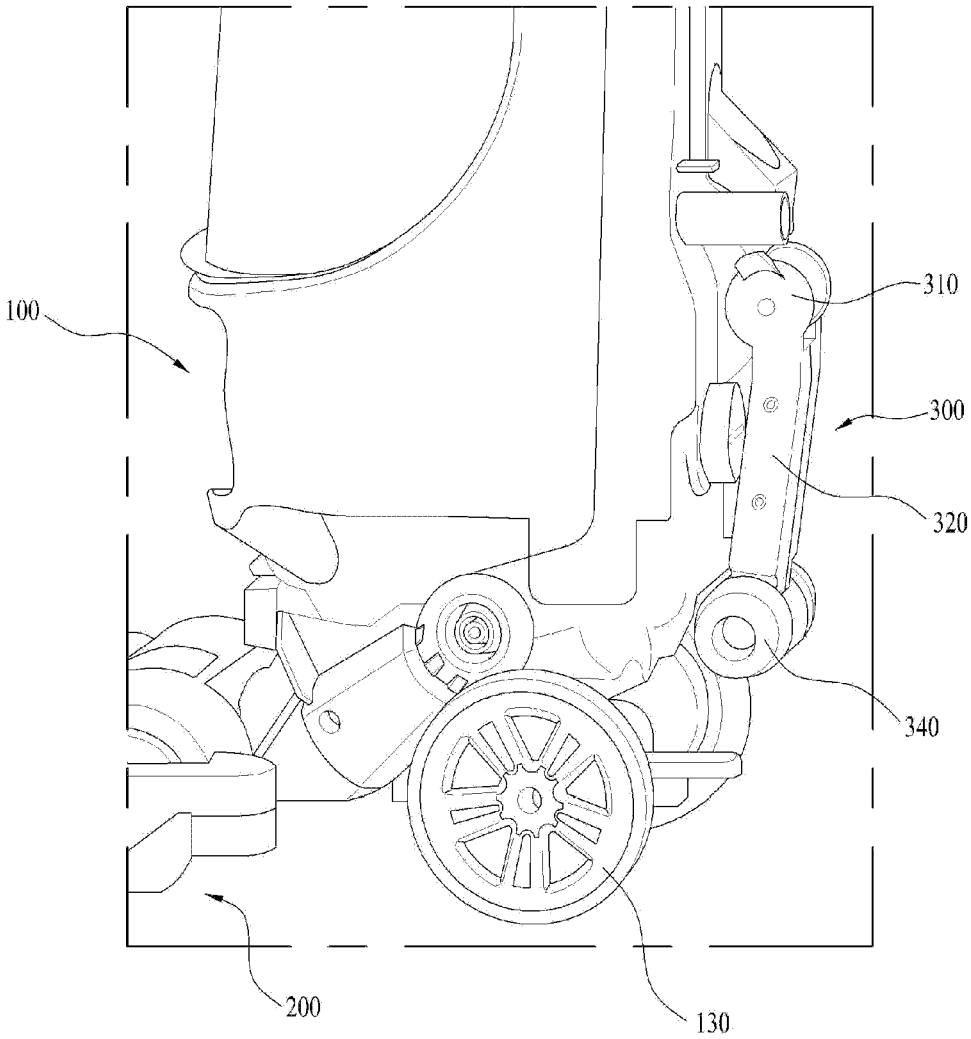
FIG. 2 is a perspective view illustrating a rear surface of the upright type vacuum cleaner according to the embodiment.

FIG. 2 is a perspective view illustrating a rear surface of the upright type vacuum cleaner according to the embodiment. In reference to FIG. 2, the configuration and operation of the upright type vacuum cleaner according to the embodiment will be described in detail.

As mentioned above, description of the same component elements as those of the upright type vacuum cleaner shown in FIG. 1 will be omitted.

As shown in FIG. 2, a supporting unit 300 may be rotatably provided in a rear surface of the main body 100.

An upper end of the supporting unit 300 may be rotatably coupled to the rear surface of the main body 100 and a lower end of the supporting unit 300 may be fixed to the rear surface of the main body 100 by a fixing device (not shown) provided in the main body 100, in close contact with that.

That is, when the user does not use the supporting unit 300 during the cleaning or user keeps it in a storage space, the lower end of the supporting unit 300 may be fixed to the rear surface of the main body 100 by the fixing device in close contact to perform the cleaning efficiently or to utilize the storage space efficiently by reducing a volume of the main body 100.

Figure 3:
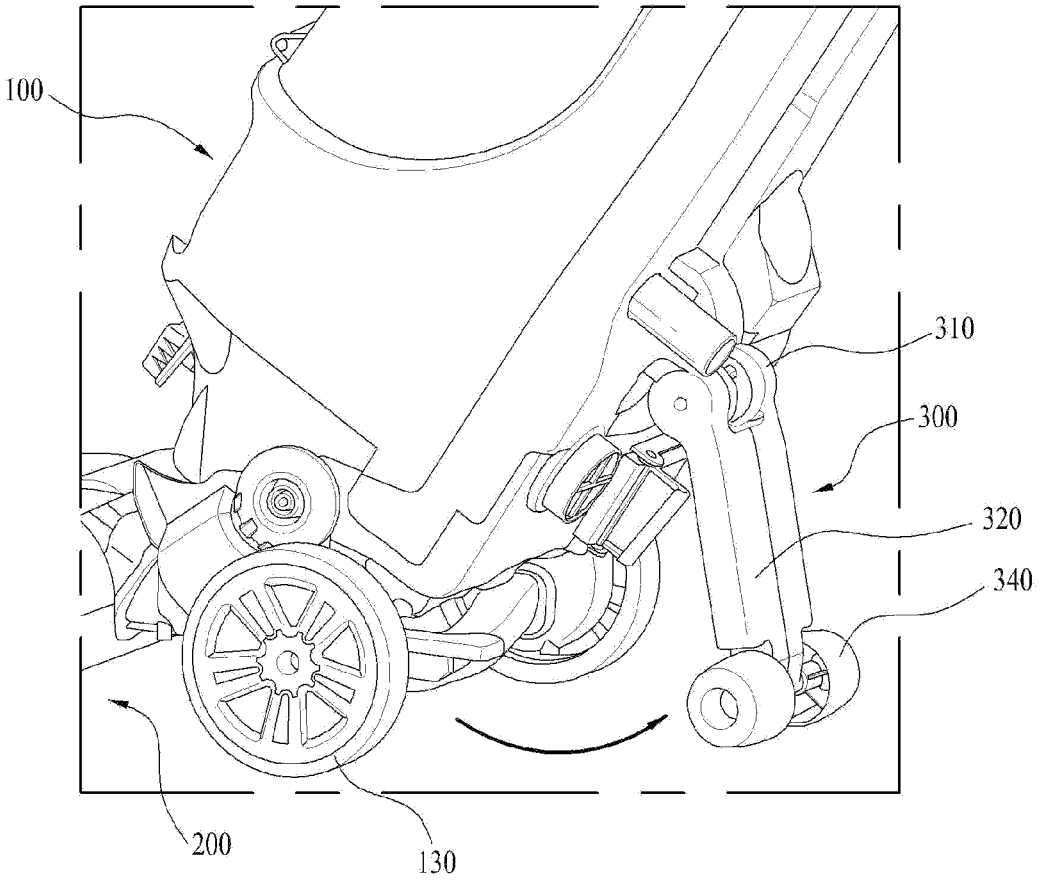
FIG. 3 is a perspective view illustrating a supporting unit provided in the upright type vacuum cleaner, which supports a main body.

FIG. 3 is a perspective view illustrating the state of the supporting unit 300 supporting the main body 100 in the upright type vacuum cleaner according to the embodiment. In reference to FIG. 3, the structure that the supporting unit 300 supports the main body 100 during the cleaning will be described in detail.

In other words, when the user performing the cleaning by rotating the main body 100 toward the surface to clean to change the arrangement angle of the main body 100 with respect to the surface, the supporting unit 300 may move the main body 100 to a supporting position with respect to the surface to clean.

When the supporting unit 300 may support the main body 100 with respect to the surface to be cleaned, the supporting unit 300 may distribute a load of the main body 100 and the user may perform the cleaning smoothly, without concern of the load applied to the main body 100.

Figure 4:
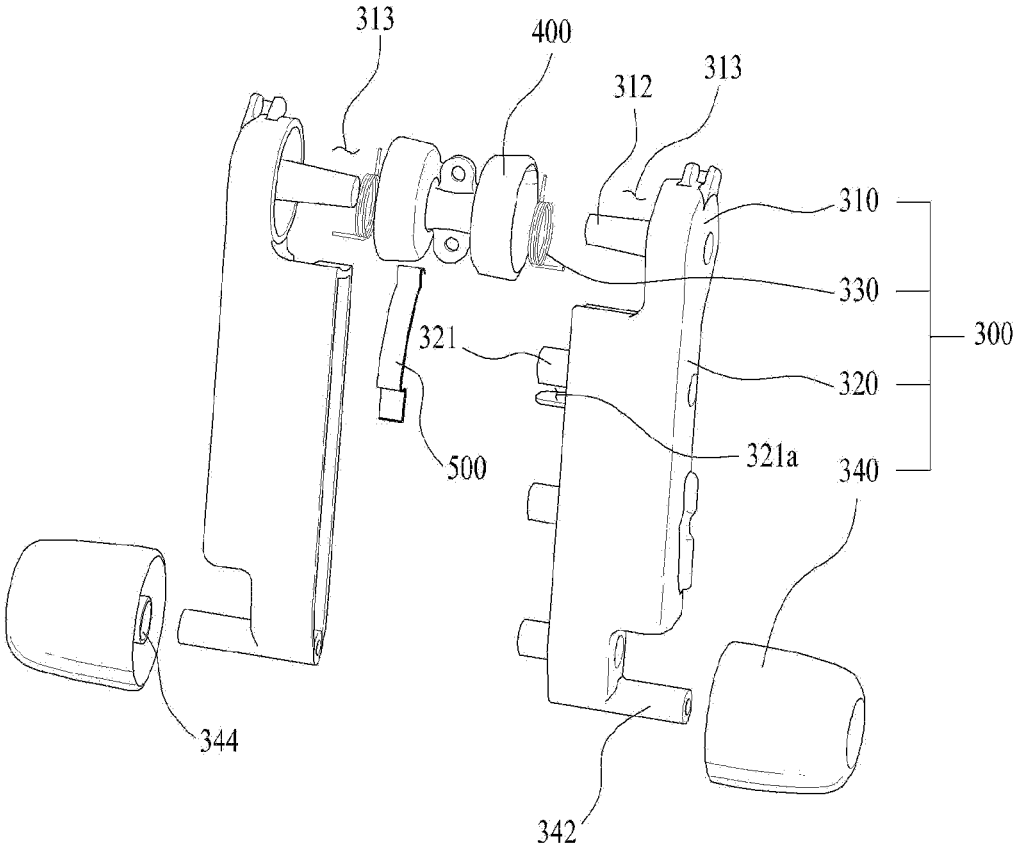
FIG. 4 is an exploded perspective view illustrating the supporting unit of the upright type vacuum cleaner according to the embodiment.

FIG. 4 is an exploded perspective view illustrating the supporting unit 300 of the upright type vacuum cleaner according to the embodiment. In reference to FIG. 4, the structure and function of the supporting unit 300 according to the embodiment will be described in detail.

As mentioned above, the supporting unit 300 may be rotatably coupled to the rear surface of the main body 100 and it may support the main body 100 rotated a predetermined angle toward the surface to be cleaned, to distribute the load of the main body 100.

Such the supporting unit 300 may include a rotation part 310 rotatably coupled to the main body 100, a supporting part 320 extended from the rotation part 310 and an auxiliary wheel 340 rotatably coupled to an end of the supporting part 320.

The rotation part 310 may be provided at an upper end of the supporting unit 300, to be rotatably coupled to a connection member 400 provided in the main body 100.

In other words, a rotation shaft 312 may be provided in a predetermined area of the rotation part 310, in opposite to the connection member 400. The rotation shaft 312 may be coupled to the connection member 400 to allow the rotation part 310 to rotate on the rotation shaft 312.

The supporting part 320 extended from the rotation part 310 may be fixedly in close contact with the main body 100 or it may be rotated on the rotation shaft 312, based on the user's selection, to support the predetermined angle rotated main body 100 toward the surface to clean.

In the meanwhile, a recess part 313 may be formed at an end of the supporting part 320 to receive the connection member 400 rotatably connected with the shaft 312.

A fixing boss 321 may be provided in the supporting part 320 to fixedly insert a proper area of a fixing member 500 therein. Here, the fixing member 500 will be described later. A slot 321*a* may be formed in the fixing boss 321 to insert a bending part (521, see FIG. 5) of the fixing member 500 therein.

Here, the supporting unit 300 may be divided into two pieces fitted to each other. Alternatively, it may be composed of a single member.

In the meanwhile, the auxiliary wheel 340 may be rotatably coupled to the end of the supporting part 320. When the user performs the cleaning, with the supporting part 320 supporting the main body 100, the auxiliary wheel 340 may be rotated and a motion ability and steering ability of the vacuum cleaner may be improved.

In other words, wheel shafts 342 may be provided both sides of the end of the supporting part 320. When the main body 100 is moved, the wheel shafts 342 may be inserted in a wheel recesses 344 provided in the auxiliary wheel 340 to make the auxiliary wheel 340 rotated on the wheel shaft 342.

An elastic member 330 may be disposed between the rotation part 310 and the connection member 400.

The elastic member 330 may be a torsion spring having both ends that are able to be projected a proper length along an outer circumferential surface.

The end of the elastic member 330 may be fixed to the connection member 400 and the other end thereof may be fixed to the rotation part 310. When the supporting unit 300 is rotated, an elastic restitution accumulates and the elastic restitution may restitute the supporting unit 300 when an external force applied to rotate the supporting unit 300 is removed.

In other words, such the elastic member 330 may provide an elastic force with the rotation part 310 such that the supporting unit 300 may move from the position fixedly in close contact with the rear surface of the main body 100 toward the position supporting the main body 100.

The fixing member 500 may be provided in the supporting unit 300. The fixing member 500 may be fixedly inserted in the supporting part 320 and it may prevent the supporting unit 300 from relieved from the state of supporting the main body 100 by the friction generated between the supporting unit 300 and the surface to clean when the main body 100 is moved.

The structure and function of the fixing member 500 will be described in detail in reference to FIGS. 5 and 6.

Figure 5:
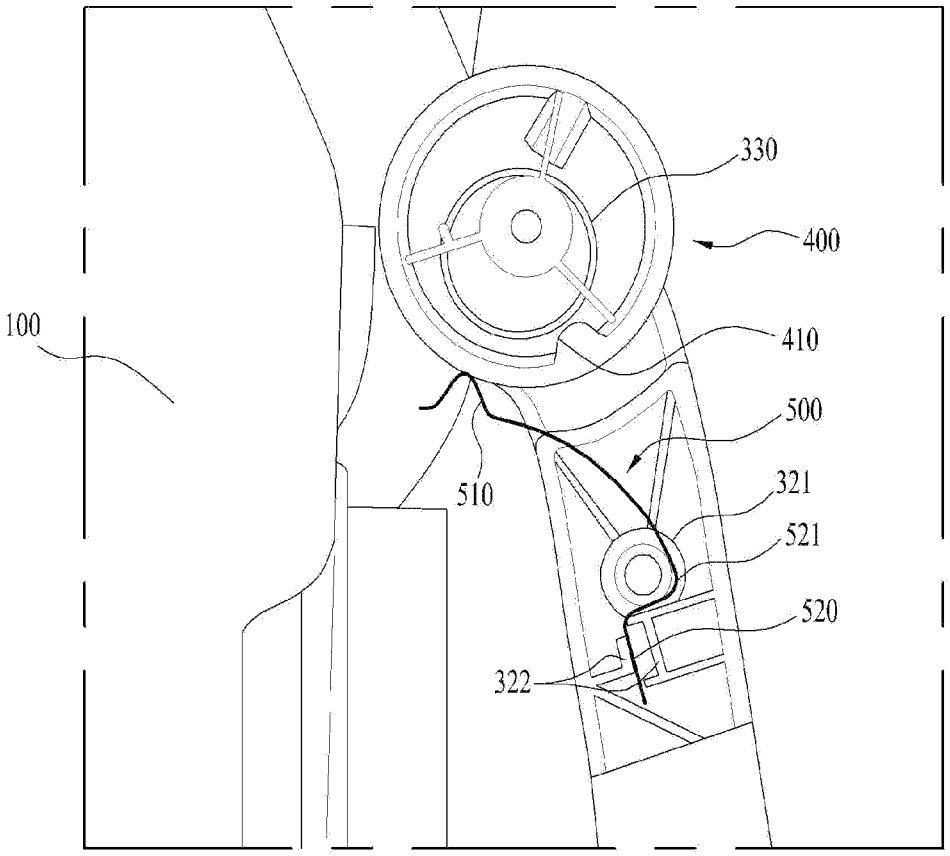
FIGS. 5 and 6 are side sectional views illustrating the supporting unit of the upright type vacuum cleaner according to the embodiment.
Figure 6:
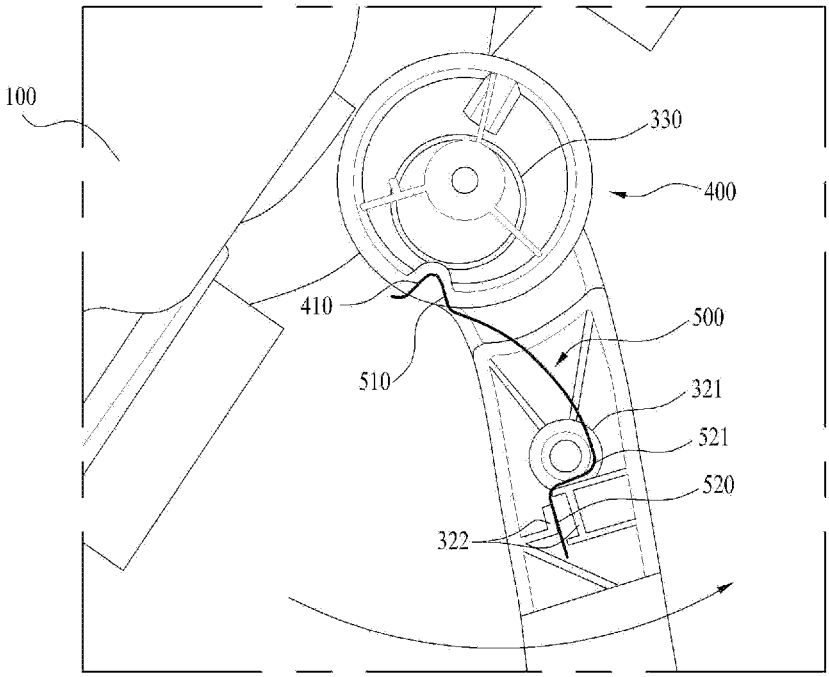

FIGS. 5 and 6 are side sectional vies illustrating the supporting unit 300 of the upright type vacuum cleaner according to the embodiment.

As shown in FIG. 5, the fixing member 500 may include a engagement part 510 provided at an end thereof and a fixing part 520 provided at the other end. The fixing part 520 may be inserted in a rib 322 provided in the supporting part 320, only to fix the fixing member 500 in the supporting unit 300.

In the meanwhile, a bending part 521 may be provided adjacent to the fixing part 520 and the bending part 521 may be fixedly inserted in the slot (321*a*, see FIG. 4) of the fixing boss 321.

When the supporting unit 300 is fixed in close contact with the rear surface of the main body 100 provided in the upright type vacuum cleaner, the engagement part 510 may maintain the contact with an outer circumferential surface of the connection member 400 provided in the main body 100.

When the supporting unit 300 is moved to the position supporting the predetermined angle rotated main body 100 toward the surface to clean as shown in FIG. 6, the rotation part 310 may be rotated along a direction (a counter-clockwise direction in FIG. 6) and the engagement part 510 may be relative-moved with respect to the outer circumferential surface of the connection member 400 along the outer circumferential surface of the connection member 400, only to be received in a engagement recess 410 formed in the connection member 400.

In other words, the engagement recess 410 is configured to limit the movement of the engagement part 510 and it may be provided on the outer circumferential surface of the connection member 400.

Since the engagement part 510 is received and engaged to the engagement recess 410, the supporting unit 300 may maintain the state of supporting the main body 100 when the main body 100 is moved.

Because of that, the rotation of the supporting unit 300 may be limited and the arrangement state of the supporting unit 300 may be maintained.

As a result, the load of the main body may be partially transferred to the supporting unit 300, in a state of tilting the main body 100, and the tilted state of the main body 100 may be maintained constantly.

When the supporting unit 300 is performing the rotational movement, the engagement part 510 may perform the relative movement with respect to the connection member 400 along the outer circumferential surface of the connection member 400. When the supporting unit 300 is rotated a predetermined angle rearward, the engagement part 510 may be engaged by the engagement recess 410.

In the meanwhile, the position of the supporting unit 300 may be fixed even when a friction generated between the supporting unit 300 and the surface to clean is applied to the supporting unit 300 along an opposite direction to the movement direction of the main body 100. Because of that, the friction may not affect the supporting state of the supporting unit 300 with respect to the main body 100.

Here, the end of the fixing member is bent to form the engagement part 510 which will be received in the engagement recess 410. The engagement recess 410 may be formed in a shape corresponding to the shape of the engagement part 510.

Also, the engagement part 510 may be an auxiliary independent member that may be coupled to the end of the fixing member 500.

In the meanwhile, when the user tries to contact the supporting unit 300 with the rear surface of the main body 100 closely after performing the cleaning, a predetermined power may be applied to the supporting unit 300 by the user's feet and the like to push the supporting unit 300 forwardly, namely, toward the rear surface of the main body 100 and the engagement of the engagement part 510 may be then unlocked from the engagement recess 410.

In other words, the supporting unit 300 may be pressed by a predetermined force corresponding to a preset reference or more forwardly, with the engagement part 510 engaged by the engagement recess 410. After that, the engagement between the engagement part 510 and the engagement recess 410 may be removed to allow the supporting unit 300 rotated forwardly.

As the engagement part 510 is moved along the outer circumferential surface of the connection member 400, the supporting unit 300 may be restituted to the position in close contact with the rear surface of the main body 100 as shown in FIG. 5.

In addition, the elastic force of the elastic member 330 may accelerate the restitution of the supporting unit 300 more quickly.

The positions of engagement part 510 have to be variable from the position received in the engagement recess 410 to the position relieved from the engagement recess 410. Because of that, the fixing member 500 may be formed of a material that is elastically transformed.

The fixing member 500 according to this embodiment is represented as a kind of a plate spring and the embodiment may not be limited thereby.

Figure 7:
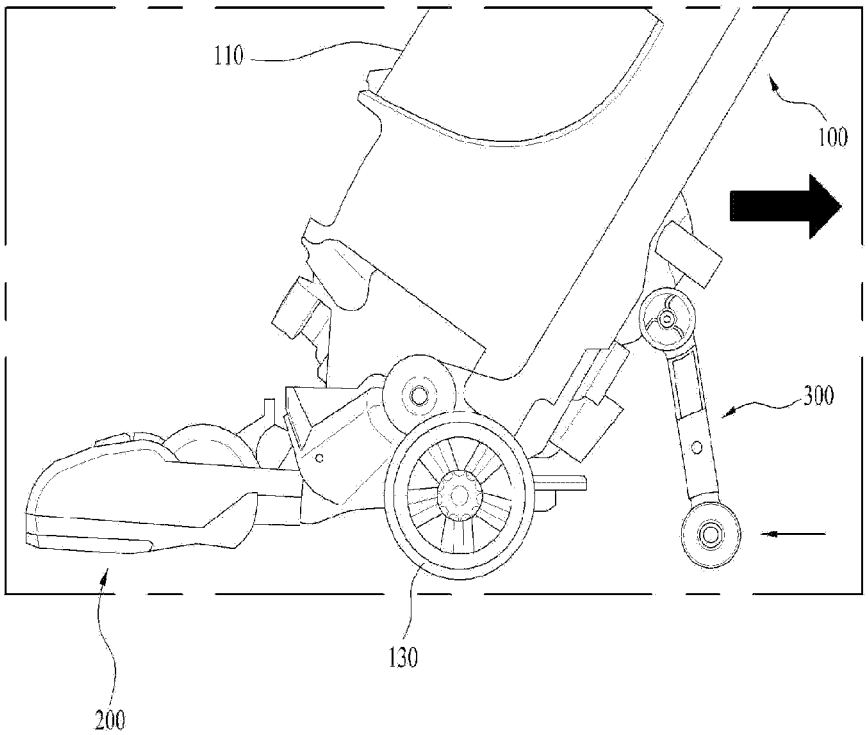
FIG. 7 is a side sectional view illustrating a state of the supporting unit provided in the upright type vacuum cleaner according to the embodiment, which is supporting the main body.

FIG. 7 is a side sectional view illustrating the supporting unit 300 supporting the main body 100 in the upright type vacuum cleaner according to the embodiment.

As shown in FIG. 7, when the user moves the main body 100 along a direction (referenced to as 'large arrow') in the cleaning, the friction generated between the supporting unit 300 and the surface to clean may be applied along the opposite direction (referenced to as 'small arrow') of the movement direction of the main body 100.

As a result, the fixing member mentioned above may be provided in the supporting unit 300 and the supporting unit 300 may be prevented from bending toward the rear surface of the main body 100.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An upright type vacuum cleaner comprising:

a main body comprising an arrangement angle that is changeable with respect to a surface to be cleaned;

a suction nozzle coupled to the main body, the suction nozzle movable along the surface to be cleaned;

a supporting unit provided in the main body to support the main body with respect to the part to the surface to be cleaned;

a connection member provided between the main body and the supporting unit, to rotatably connect the supporting unit with the main body; and a fixing member fixedly provided between the supporting unit and the connection member to limit the rotation of the supporting unit, to maintain the main body supporting of the supporting unit.

2. The upright type vacuum cleaner of claim 1, wherein the fixing member comprises, an engagement part selectively engaged by the connection member for the supporting unit to maintain the main body supporting of the supporting unit, when the main body is moved; and a fixing part fixed to the supporting unit.

3. The upright type vacuum cleaner of claim 2, wherein an engagement recess is formed in the connection member to limit the movement of the engagement part.

4. The upright type vacuum cleaner of claim 3, wherein the supporting unit is separable and the connection member is rotatatbly coupled to an end of the supporting unit, and the supporting unit comprises, a rotation part comprising a rotation shaft rotatably coupled to the connection member; and a supporting part extended from the rotation part to support the main body with respect to the surface to be cleaned.

5. The upright type vacuum cleaner of claim 4, wherein the supporting unit comprises a plurality of parts that are able to be coupled to each other or separable from each other, and a recess part is formed in an end of the supporting unit to receive the connection member.

6. The upright type vacuum cleaner of claim 4, wherein a rib is provided in the supporting part to insert the fixing part therein.

7. The upright type vacuum cleaner of claim 6, wherein the fixing member further comprises a bending part provided adjacent to the fixing part, and a fixing boss comprising a slot to fixedly insert the bending part therein is provided in the supporting part.

8. The upright type vacuum cleaner of claim 4, wherein the supporting unit further comprises, an elastic member disposed between the rotation part and the connection member to provide the rotation part with an elasticity, to move the supporting part from a position in close contact with a rear surface of the main body to a position supporting the main body.

9. The upright type vacuum cleaner of claim 4, wherein the supporting unit further comprises an auxiliary wheel rotatably coupled to an end of the supporting part.

10. The upright type vacuum cleaner of claim 3, wherein the engagement part is formed by bending an end of the fixing member, to be received in the engagement recess.

11. The upright type vacuum cleaner of claim 10, wherein the fixing member is formed of a material having elasticity to change the position of the engagement part engaged to the engagement recess into a position out of the engagement state.

12. The upright type vacuum cleaner of claim 3, wherein the engagement recess is formed in an outer circumferential surface of the connection member, and the engagement part is provided to perform relative-movement with respect to the connection member along the outer circumferential surface of the connection member, when the supporting unit performs rotational movement, and the engagement part is engaged to the engagement recess when the supporting unit is rotated a predetermined angle rearward.

13. The upright type vacuum cleaner of claim 12, wherein the engagement between the engagement part and the engagement recess is released and the supporting unit may be forwardly rotated, when the supporting unit is forwardly pressed by a force corresponding to a preset reference or more.

14. An upright type vacuum cleaner comprising:

a main body comprising an arrangement angle that is changeable with respect to a surface to be cleaned;

a suction nozzle coupled to the main body, the suction nozzle moving along the surface to clean be cleaned;

a supporting unit provided in the main body to support the main body, when the main body is tilted with respect to the surface to be cleaned;

a connection member provided between the main body and the supporting unit to support the main body, to rotatably connect the supporting unit with the main body; and a fixing member fixedly provided between the supporting unit and the connection member, the fixing member configured to fix the supporting unit to the connection member or to remove the fixing state based on a rotation direction of the supporting unit.

15. The upright type vacuum cleaner of claim 14, wherein the fixing member is elastically transformed and the fixing member comprises, a fixing part fixed to the supporting unit; and a engagement part movable along an outer circumferential surface of the connection member in contact therewith, to be selectively engaged to the outer circumferential surface of the connection member based on a rotation state of the supporting unit.

16. The upright type vacuum cleaner of claim 15, wherein the connection member further comprises, a engagement recess provided in the outer circumferential surface thereof, to engage the engagement part thereto to limit the rotation of the supporting unit, and the engagement part is formed by bending a predetermined area of the fixing member to be received in the engagement recess.

17. The upright type vacuum cleaner of claim 16, wherein the engagement between the engagement part and the engagement recess is released and the supporting unit is rotated forwardly, when the supporting unit is forwardly pressed by a force corresponding to a preset reference or more, with the engagement part engaged to the engagement recess.

18. The upright type vacuum cleaner of claim 15, wherein the supporting unit is separable and the connection member is rotatably coupled to an end of the supporting unit, and the supporting unit comprises, a rotation part comprising a rotation shaft rotatably coupled to the connection member; and a supporting part extended from the rotation part to support the main body with respect to the surface to be cleaned, and an auxiliary wheel is rotatably coupled to an end of the supporting part.

19. The upright type vacuum cleaner of claim 15, wherein the fixing member further comprises a bending part provided adjacent to the fixing part, and a rib to insert the fixing part therein and a fixing boss comprising a slot to fixedly insert the bending part therein are provided in the supporting part.

20. The upright type vacuum cleaner of claim 14, wherein the supporting unit further comprises an elastic member disposed between the rotation part and the connection member to provide the rotation part with an elastic force, to move the supporting part from a position in close contact with the rear surface of the main body toward position supporting the main body.

* * * * *